United States Patent [19]

Wahnschaffe et al.

[11] Patent Number: 4,834,029

[45] Date of Patent: May 30, 1989

[54] INTERNAL COMBUSTION ENGINE

[75] Inventors: Jürgen Wahnschaffe, Bergisch Gladbach; Ernst-Siegfried Hartmann, Overath Bundersrepublik Deutschland; Herbert Schleiermacher, Bruhl, all of Fed. Rep. of Germany

[73] Assignee: Kloeckner-Humboldt-Deutz AG, Fed. Rep. of Germany

[21] Appl. No.: 100,926

[22] Filed: Sep. 25, 1987

[30] Foreign Application Priority Data

Oct. 2, 1986 [DE] Fed. Rep. of Germany ..... 3633576

[51] Int. Cl.[4] ..... F01P 3/02

[52] U.S. Cl. ..... 123/41.42; 123/41.08

[58] Field of Search ..... 123/41.08, 41.42

[56] References Cited

U.S. PATENT DOCUMENTS

| | | | |
|---|---|---|---|
| 2,078,499 | 4/1937 | Ljungström | 123/41.42 |
| 2,456,951 | 12/1948 | Klotsch | 123/41.42 |
| 2,611,347 | 9/1952 | Nallinger | 123/41.12 |
| 3,065,743 | 11/1962 | Brehm et al. | 123/41.08 |
| 3,127,879 | 4/1964 | Giacosa et al. | 123/41.42 X |
| 3,687,232 | 8/1972 | Stenger | 123/41.42 X |
| 3,981,279 | 9/1976 | Bubniak et al. | 123/41.08 X |
| 4,708,095 | 11/1987 | Luterek | 123/41.42 |

FOREIGN PATENT DOCUMENTS 2825870 12/1978 Fed. Rep. of Germany .

*Primary Examiner*—Tony M. Argenbright
*Assistant Examiner*—Eric Carlberg
*Attorney, Agent, or Firm*—Charles L. Schwab

[57] ABSTRACT

A cooling circuit (5) for an internal combustion engine in which a throttle (2) is provided upstream of a heat exchanger (10, 11). The throttle (2) equalizes the oil pressure in the internal combustion engine in front of the heat exchangers and insures that this occurs almost independently of the temperature of the oil. By this provision, the heat exchangers can be fabricated with the least expense since the danger of bursting is reduced.

8 Claims, 4 Drawing Sheets

INTERNAL COMBUSTION ENGINE

TECHNICAL FIELD

This invention relates to an internal combustion engine and particularly to an engine oil circuit with a heat exchanger.

PRIOR ART STATEMENT

West German Pat. No. DE-OS 28 25 870 shows and describes an internal combustion engine with a cooling oil circuit and a lubricating oil circuit which are connected in parallel to an oil supply pump. A heat exchanger (oil cooler) is provided in the cooling oil circuit and a bypass line is connected in parallel with the heat exchanger. The bypass line is regulated by a thermostat valve which, when the oil temperature is above a certain value, directs the oil through the oil cooler and, when the oil temperature is below such value, permits the oil to flow through the bypass line. In order to insure oil flow in the lubricating oil circuit when the oil pressure is low, a priority valve is provided in the cooling oil circuit which allows oil to flow through the cooling circuit only when the oil pressure is above a predetermined value.

When the oil temperature is low, an unacceptably high pressure can develop in the heat exchanger because of the high viscosity of the oil. This condition can result in the heat exchangers being damaged since such heat exchangers are often of low cost fabrication as a cost-saving measure and thus their safety factors are low as relates to pressures exceeding the operating pressure.

The arrangement of a thermostat valve within a bypass line of the heat exchanger, as is described in West German Pat. No. DE-OS 28 25 870, permits the oil to flow through the bypass line whenever the oil temperatures are low.

The disadvantage therein lies in the fact that an unnecessarily great quantity of oil is pumped continuously through the cooling air circuit.

OBJECTS AND SUMMARY OF THE INVENTION

An object of this invention is to equalize the oil pressure in an internal combustion engine upstream of the heat exchangers, using simple means and avoiding the above-mentioned disadvantage, so that it is nearly independent of the oil temperature.

A throttle is provided in the cooling oil circuit upstream of the heat exchangers. When the oil is in cold condition it is viscous so there is greater resistance to the oil flowing through the throttle than when the oil is warm. As a result, the oil pressure increases in front of the throttle causing the pressure-relief valve to open in the oil return line and bypass the oil back to an oil sump.

A portion of the oil will, however, succeed in passing the throttle and be heated by it in the cooling oil circuit. In this way the internal combustion engine is heated as an advantageous side effect. If the temperature of the oil increases in front of the throttle, the oil thus becomes thinner and continuously decreases the throttling effect. Because of this, the oil pressure in front of the heat exchangers is equalized and is thus nearly independent of the oil temperature.

It is advantageous to arrange the throttle upstream of the first point to be cooled on the internal combustion engine, in order to guarantee heating of the entire internal combustion engine.

A simple, cost-efficient design for the throttle may be achieved by designing it as a borehole in the casing of the internal combustion engine.

In one embodiment of the invention, a priority valve is arranged in the cooling oil circuit, which includes a spring-loaded piston fitted in a socket-like chamber. Advantageously, the throttle is integrated into the priority valve, whereby it is convenient to provide a restricted opening, in the form of clearance between the piston and the walls of the chamber, through which the cooling oil flows when the valve is in open condition.

It is also possible to position the throttle in the area of the heat exchanger, and particularly to integrate the throttle into the heat exchanger.

BRIEF DESCRIPTION OF THE DRAWINGS

The invention is illustrated by the drawings, in which.

DETAILED DESCRIPTION OF THE DRAWINGS

Figure 1:
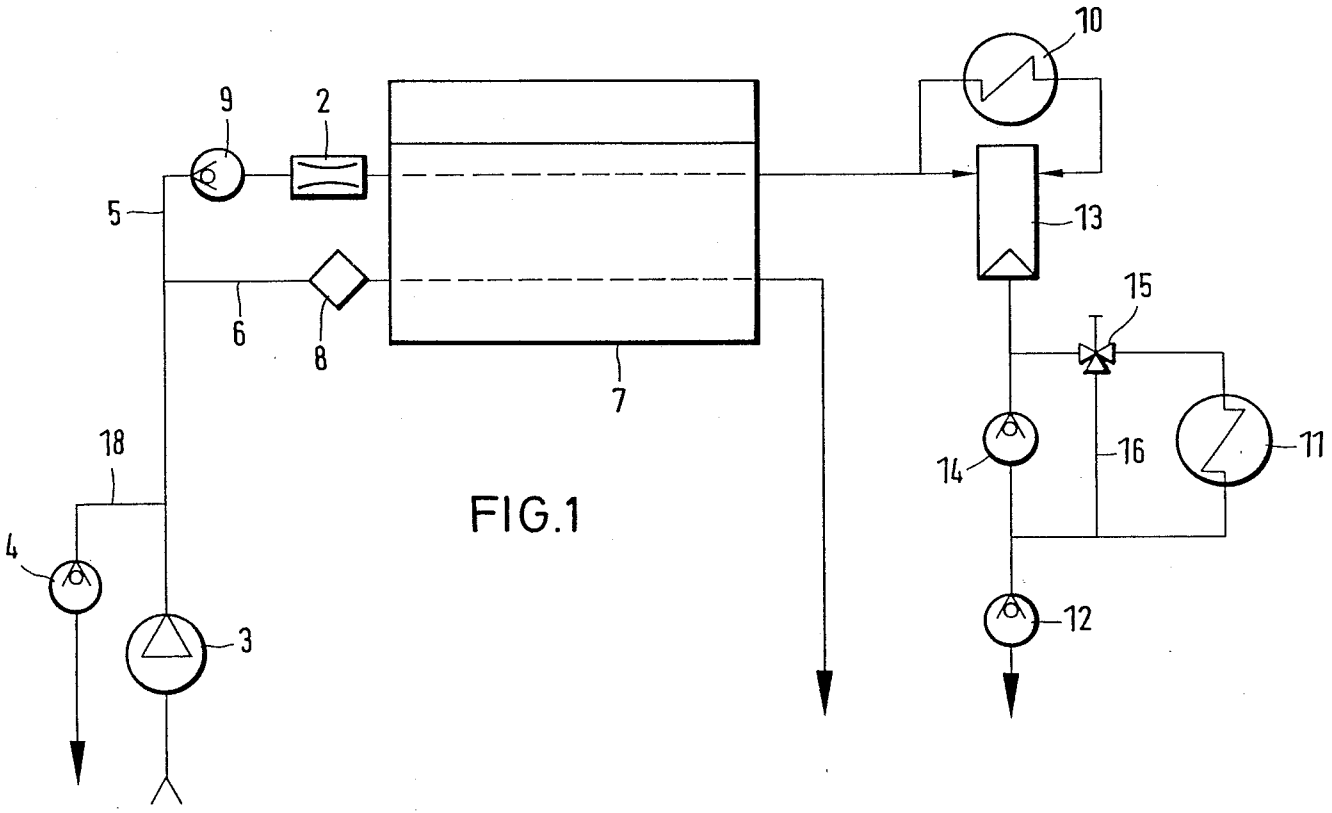
FIG. 1 is a schematic showing of an oil circulation system for an internal combustion engine in which the cooling oil circuit and the lubricating oil circuit are supplied by a common oil pump.

In FIG. 1 an oil system of an internal combustion engine is shown in which cooling oil and lubricating oil circuits 5, 6 are supplied by a common oil pump 3. A pressure-relief valve 4 is positioned in an oil return 18 in the direction of the flow downstream of the oil pump 3 so as to control the flow in the oil return line 18 and thus limit the maximum oil pressure in the circuits 5, 6. The oil which is supplied by the oil pump 3 is divided into two partial flows, one of which forms the cooling oil circuit 5 and the other the lubricating oil circuit 6. An oil filter is provided in the lubricating oil circuit 6 upstream of the engine 7 and a minor portion of the oil supplied by the pump 3 flows through lubricating oil circuit 6.

In the cooling oil circuit 5, a priority valve 9 is installed upstream of the engine which gives oil supply priority to the lubricating oil circuit. Upstream of the engine, a throttle 2 is provided in the cooling oil circuit in series with the priority valve 9. The throttle may take the form of a borehole in the casing of the engine. Two heat exchangers, namely an engine oil cooler 10 and a heater 11, are arranged in series in the cooling oil circuit 5 downstream of the engine 7 and upstream of a pressure regulating valve 12. The engine oil cooler 10 is regulated by a thermostat 13 which directs oil through the engine oil cooler 10 when the oil temperature exceeds a predetermined high value. The heater 11, located downstream of the engine oil cooler 10, is regulated by a heating valve 14 which is open when the oil temperature is high and is closed when the oil temperature is below a predetermined low value so as to direct oil to the heater 11. In addition, a control valve 15 is arranged for regulating the flow to the heater 11 and controls flow through a bypass 16 around the heater 11.

The oil pressure in front of the heat exchangers is equalized by the throttle 2, and thus the danger of the heat exchangers bursting is reduced.

It is advantageous, as is shown in FIG. 1, to arrange the throttle in the direction of flow in the cooling oil circuit of the internal combustion engine before the first point which is to be cooled in order to guarantee heating of the entire internal combustion engine.

Figure 2:
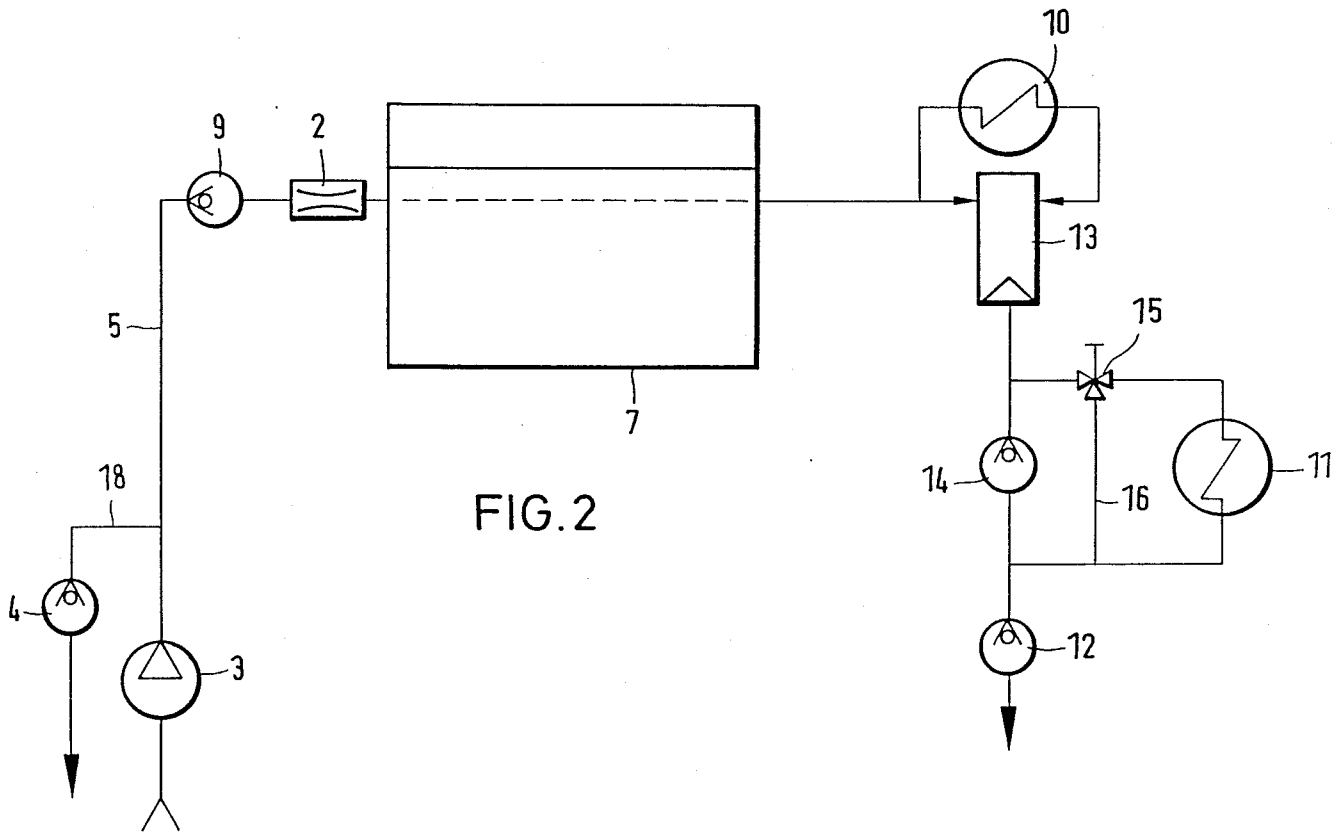
FIG. 2 is a schematic showing of a cooling oil circuit of an internal combustion engine which is supplied by its own oil pump.

FIG. 2 shows the same arrangement of the cooling oil circuit as is shown in FIG. 1, only here the cooling oil circuit is supplied by a separate oil pump 3.

Figure 3:
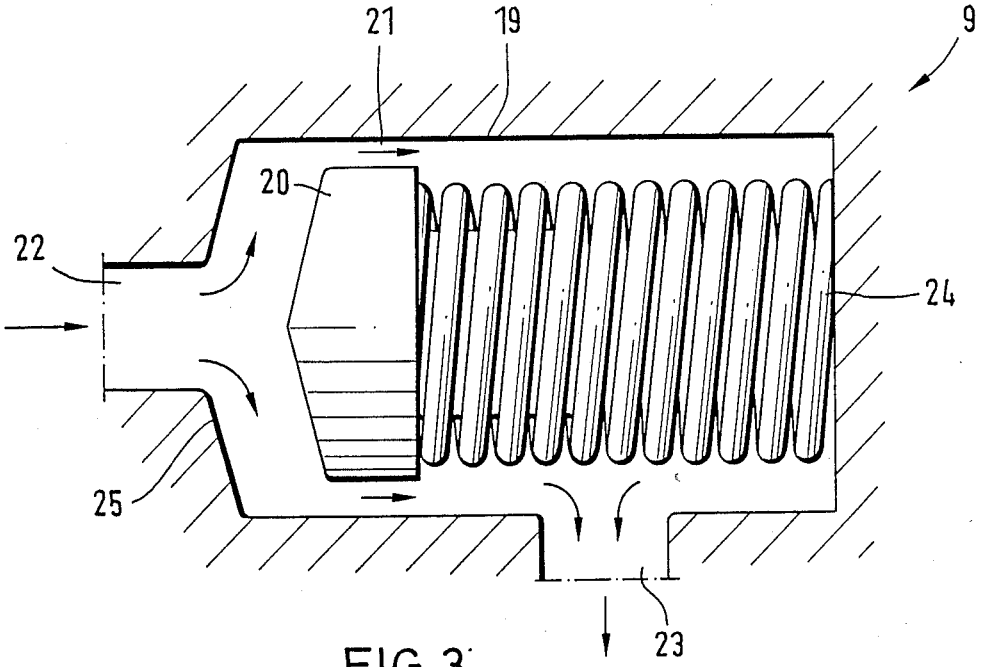
FIG. 3 shows a valve of this invention which has been integrated into a priority valve.

FIG. 3 illustrates a priority valve 9 with an integrated throttle which is suitable for installation in the cooling oil circuit of an internal combustion engine. The priority valve 9 includes walls defining a cylindrical chamber 19 with a coaxial valve inlet 22 and a valve outlet 23. A piston 20 is coaxially installed in the chamber 19 and is biased toward its closed position by a coil compression spring 24. A restricted opening or clearance 21 between the circumference of the piston 20 and the cylindrical wall of the chamber 19 restricts oil flow and thus operates as a throttle. When the priority valve 9 is in its closed condition, the conically shaped end of the piston 20—biased by the spring 24—seats on a conically shaped valve seat 25 at the valve inlet 22 and thus closes it. After a specifiable oil pressure has been attained, the piston 20 moves against the biasing of the spring 24 to an open position, as shown in FIG. 3, wherein the oil flows from the valve inlet 22 through the restricted passage or opening 21 to the valve outlet 23. The arrows in FIG. 3 represent the flow of the oil when the priority valve 9 is in its open condition.

It is important to recognize that the effect of the throttle is fundamentally different than that of a thermostat valve. A thermostat valve is either "open" or "closed," depending on the temperature of the oil, while the throttle provides continuous temperature-dependent regulation of flow because of the varying viscosity of the oil as the oil temperature changes.

The throttle cross-section is chosen for the circuit so that only a temperature-regulated quantity of oil will pass the throttle, while the remaining portion of oil is available for other uses.

A throttle thus equalizes the oil pressure upstream of the oil cooler by reducing the passage flow quantity, as opposed to a thermostat valve which, below a certain temperature, blocks the flow of oil through the oil cooler bypass and thus permits the oil pressure in the oil cooler to abruptly increase.

Figure 4:
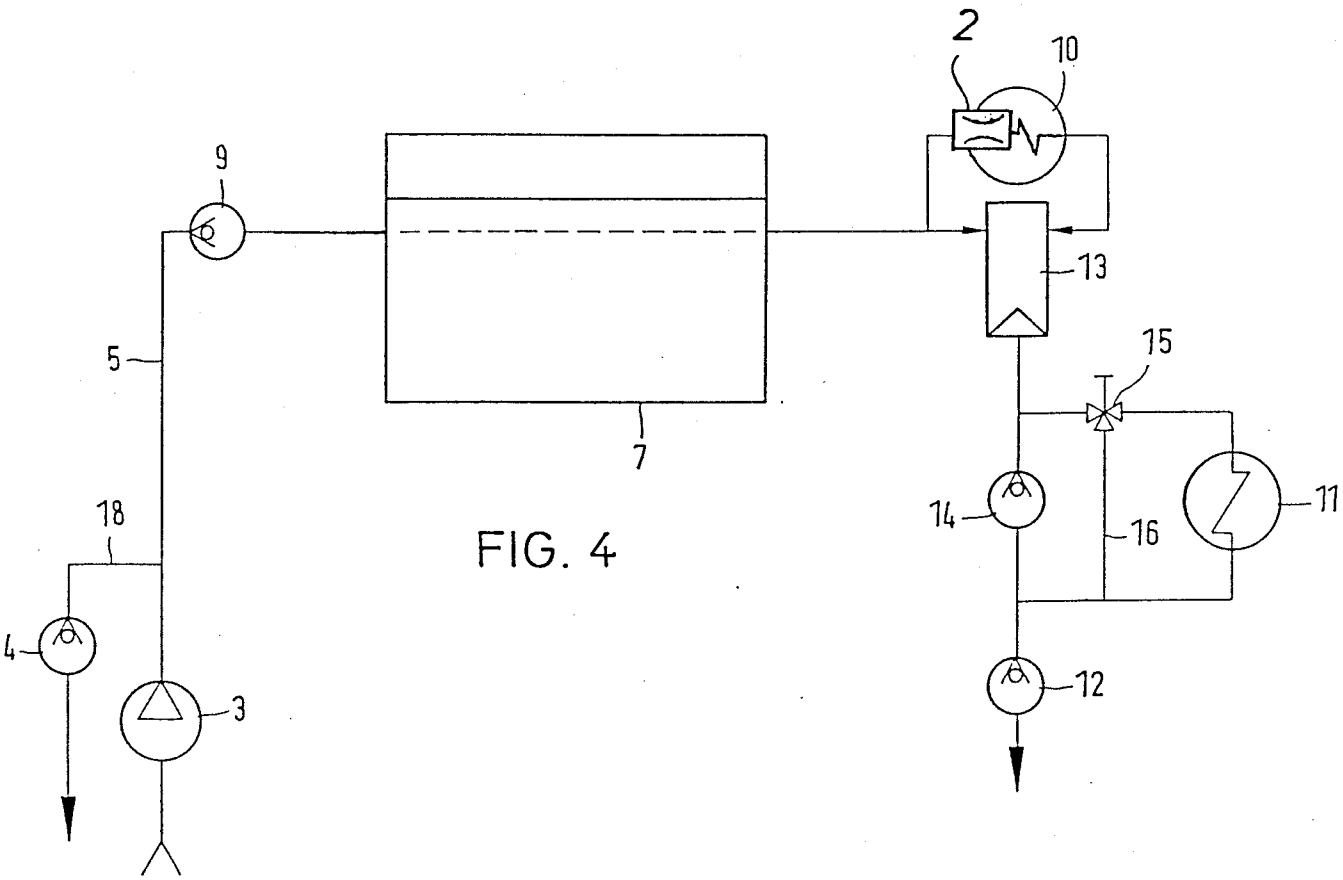
FIG. 4 is a schematic showing of an embodiment of the invention in which the throttle is incorporated into the oil cooler.

In the embodiment of the invention shown in FIG. 4 the throttle 2 is incorporated in the heat exchanger 10 and as in the other embodiment it protects the heat exchanger 10 against excessive pressure and slows the coolant flow through the engine when the oil is cold and thick.

The embodiments of the invention in which an exclusive property or privilege is claimed are defined as follows:

1. An internal combustion engine with a cooling oil circuit (5) and a lubricating oil circuit (6), at least one oil pump (3) supplying oil to said circuits, and a heat exchanger which is arranged within the cooling oil circuit (5) downstream of said engine characterized by: a throttle (2) in said cooling oil circuit upstream of the heat exchanger whereby all the cooling oil passing through said heat exchanger passes through said throttle, an oil return line (18) connected to said cooling oil circuit between said oil pump (3) and said throttle (2) and a pressure relief valve (4) in said oil return line (18).

2. The internal combustion engine of claim 1 wherein said throttle (2) is a borehole in the casing of the internal combustion engine.

3. The internal combustion engine of claim 1 wherein said throttle (2) is installed in said cooling oil circuit (5) upstream of the first point of said internal combustion engine which is to be cooled.

4. An internal combustion engine of claim 3 wherein said throttle is a borehole in the casing of said engine.

5. The internal combustion engine of claim 1 and further comprising a priority valve (9) in said cooling oil circuit (5) including walls defining a fluid chamber (19) and a spring-loaded piston (20) in said chamber (19), said throttle (2) being integrated into said priority valve (9).

6. The internal combustion engine of claim 5 wherein said throttle is effected by providing a restricted opening (21) between said piston (20) and said walls of said fluid chamber (19), through which the cooling oil flows when said priority valve (9) is open.

7. The internal combustion engine of claim 5 wherein said priority valve (9) is installed in said cooling oil circuit (5) upstream of the first point of said internal combustion engine which is to be cooled.

8. The internal combustion engine of claim 1 wherein said throttle (2) is positioned in the area of said heat exchanger.

* * * * *